US011009257B2

(12) United States Patent
Hernandez

(10) Patent No.: US 11,009,257 B2
(45) Date of Patent: May 18, 2021

(54) H.V.A.C. CONDENSATE CLEAN OUT

(71) Applicant: Carlos Teodoro Hernandez, Orlando, FL (US)

(72) Inventor: Carlos Teodoro Hernandez, Orlando, FL (US)

( * ) Notice: Subject to any disclaimer, the term of this patent is extended or adjusted under 35 U.S.C. 154(b) by 180 days.

(21) Appl. No.: 16/107,331

(22) Filed: Aug. 21, 2018

(65) Prior Publication Data

US 2019/0128561 A1 May 2, 2019

Related U.S. Application Data

(60) Provisional application No. 62/548,017, filed on Aug. 21, 2017.

(51) Int. Cl.
*B08B 9/035* (2006.01)
*F24F 13/22* (2006.01)

(52) U.S. Cl.
CPC ..... *F24F 13/222* (2013.01); *B08B 9/035* (2013.01)

(58) Field of Classification Search
CPC ..... F24F 13/222; B08B 9/035
USPC ..... 134/166 C
See application file for complete search history.

(56) References Cited

U.S. PATENT DOCUMENTS

| | | | | |
|---|---|---|---|---|
| 5,085,244 A * | 2/1992 | Funk | B08B 9/0321 | 134/102.1 |
| 6,041,611 A * | 3/2000 | Palmer | B08B 9/0325 | 137/240 |
| 6,427,458 B1 * | 8/2002 | Fowler | F24F 13/222 | 137/565.23 |
| 8,535,453 B1 * | 9/2013 | Gonzalez | E04D 13/08 | 134/166 C |
| 2014/0238506 A1 * | 8/2014 | Adams | F24F 13/222 | 137/312 |

* cited by examiner

*Primary Examiner* — Tinsae B Ayalew
(74) *Attorney, Agent, or Firm* — Trueba & Suarez PLLC; Roberto M. Suarez; William R. Trueba, Jr.

(57) ABSTRACT

An apparatus removes clogs from a condensate drain line. The apparatus includes: a vacuum attached to the condensate drain line, the vacuum pulling the clog material from the drain line, a control unit, an apparatus inlet forming a sealed connection point attaching the vacuum to the condensate drain line, an apparatus outlet allowing for drainage of the condensate, the outlet disposed lower than the inlet, a housing formed from durable, weatherproof material with a watertight seal, and a power supply powering the vacuum.

6 Claims, 7 Drawing Sheets

H.V.A.C. CONDENSATE CLEAN OUT

CROSS-REFERENCE TO RELATED APPLICATIONS

This application is a non-provisional of currently U.S. Provisional Patent Application No. 62/548,017, filed on 21 Aug. 2017, which is incorporated by reference as if fully set forth herein.

FIELD OF THE INVENTION

The invention disclosed broadly relates to the field of vacuum pumps, and more particularly relates to the field of H.V.A.C. condensate clean out apparatus, systems, and methods of preventing and eliminating air-conditioning drain line clogs utilizing the apparatus.

BACKGROUND OF THE INVENTION

It is known that air conditioning units generate condensate that collects in the air handler and is directed to a condensate drain line. Over time, the drain line can become clogged, either due to algae build-up or by other means due to water moving slowly or stagnating in the drain line. A clogged condensate drain line can cause the condensate to back up and collect in and around the air handler. This can further cause water damage to the surrounding building structures.

Prior attempts in the art to address the issue of clogged condensate drain lines operate by sensing that water is backing up and creating an open circuit, thereby shutting down the air conditioner until the clog is cleared. This type of solution is not desirable since it only activates after a clog has occurred. Furthermore, the shutting down of the air conditioning unit is not desirable since most homeowners would only know that the unit is non-functional and not even know about the clogged drain line.

Other attempts in the art deal with the draining of condensate by attaching a condensate pump to the drain line. These types of pumps are typically installed when gravity drainage is not possible or practical. This solution is not desirable because, as a pump, the system only operates by pumping the accumulated condensate to an outside drain. The pump operates on the presence of fluid and does nothing with respect to algae or other buildup in the drain line. Furthermore, with air introduced in the system, the pump may not operate properly, or as efficiently, as a vacuum system would to suck out any water or debris from the drain line.

Therefore, there is a need for an apparatus, system, and related method for preventing and eliminating condensate drain line clogs in air conditioning, refrigeration, and dehumidification equipment, which aims to overcome the above-stated shortcomings of the known art.

SUMMARY

An apparatus for the removing of clogs from a condensate drain line would include an electromechanical device that is sealably coupled to the condensate drain line in such a manner as to facilitate the creation of a vacuum within the condensate drain line such that the clog may be sucked out.

A preferred embodiment of the apparatus would include a weatherproof housing with an integral vacuum as well as associated electrical and electronic components. The apparatus housing further includes an inlet and an outlet for in-line connection to the condensate drain line.

DESCRIPTION OF THE DRAWINGS

The accompanying figures, together with the detailed description below, are incorporated in and form part of the specification and serve to further illustrate various embodiments and to explain various principles and advantages all in accordance with the present invention, in which.

DETAILED DESCRIPTION

Figure 1:
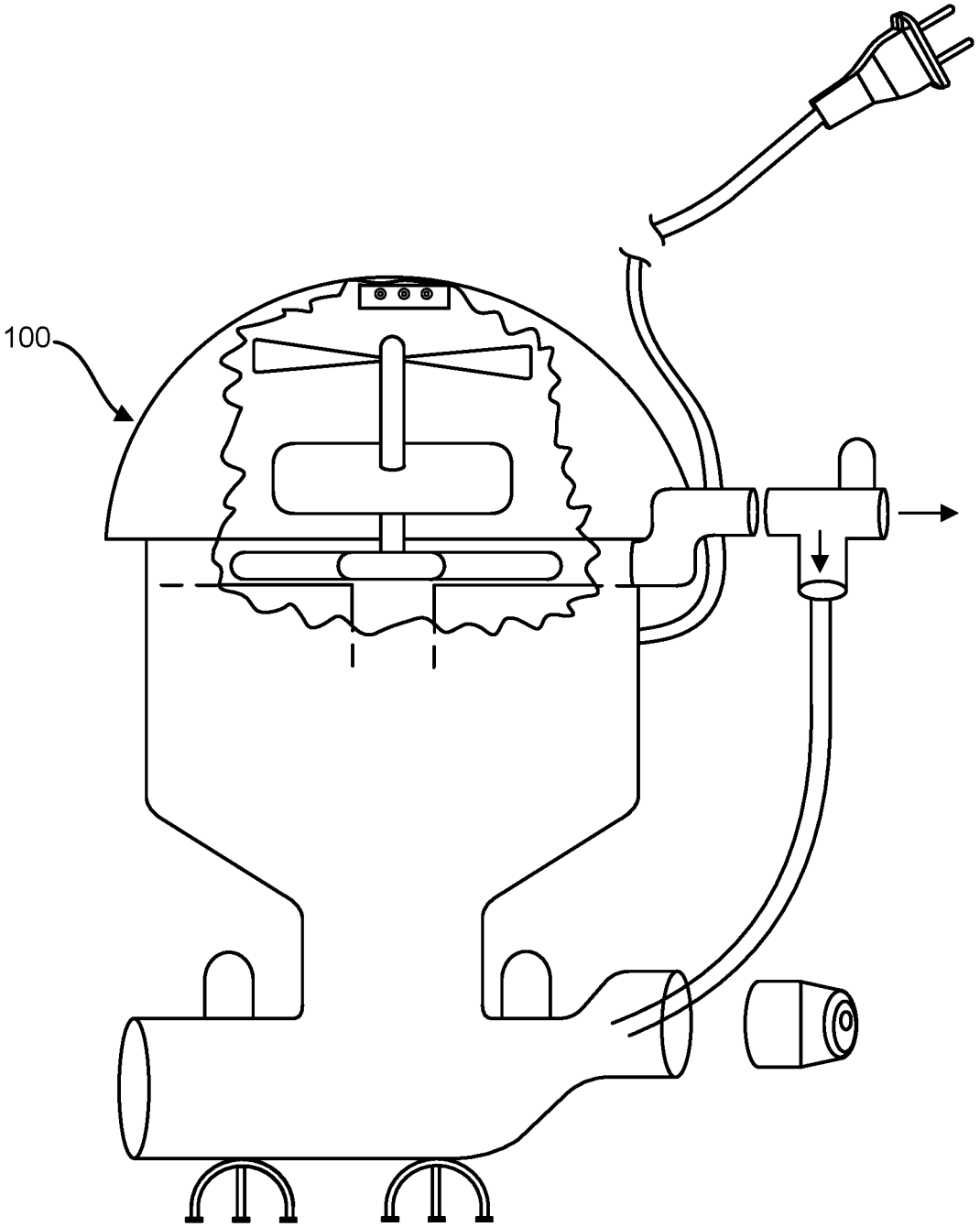
FIG. 1 is a simplified depiction of an apparatus for removing clogs from a condensate drain line, according to an embodiment.

In the Description below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, structures, steps, etc. are optionally present. For example, an article "comprising" (or "which comprises") components A, B, and C can consist of (i.e., contain only) components A, B, and C, or can contain not only components A, B, and C, but also one or more other components or structures.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40% means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

Any element in a claim that does not explicitly state "means for" performing a specified function, or "step for" performing a specific function, is not to be interpreted as a "means" or "step" clause as specified in 35 U.S.C. § 112, ¶6. In particular, the use of "step of" in the claims herein is not intended to invoke the provisions of 35 U.S.C. § 112, ¶6.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein. Specifically, component names, types, and values, as depicted in the exemplary schematic diagrams, are not intended to limit the scope of the present invention and are presented only as possible embodiments.

In this specification and in the appended drawings, words and phrases have the meanings commonly attributed to them in the relevant art except as otherwise specified herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

While the invention is disclosed herein in the context of an air conditioning unit with an attached condensate drain line, it is within the scope of the invention disclosed that the apparatus, system, and related method may also be used in other contexts, such as, but not limited to, air conditioning systems, refrigeration and dehumidification equipment, oil and gas-fired condensing furnaces, and condensing boiler equipment. The abbreviated term H.V.A.C. is known in the art to mean "Heating, Ventilation, and Air Conditioning."

Referring now to FIG. 1, a preferred embodiment of the present invention is directed to an apparatus 100 capable of removing clogs from a condensate drain line. The apparatus 100 includes a vacuum that is attached to the end of a condensate drain line, preferably after the trap. While it is contemplated that the vacuum may be placed at other convenient locations along the drain line, after the trap is preferred.

In a typical drain line installation, the drain line is connected to the H.V.A.C. unit at a drain pan and, through the action of gravity, the condensate runs through the drain line to the drain outlet at a lower elevation than the drain inlet. Since this drain outlet is typically outside of the building or structure, a curvature, or trap, is located at the end of the drain line. This trap allows water to accumulate, thereby forming a barrier against insects or small animals entering the drain line. This standing water in the trap, while beneficial for keeping out insects and small animals, may also cause algae to form and clog the drain. This is the main reason why the vacuum apparatus is preferably installed after the trap.

The apparatus 100 further includes a control unit with a timer in order to operate the vacuum at pre-set intervals such as, but not limited to, bi-weekly, monthly, quarterly, or semi-annually. An inlet creates a sealed connection point attaching the apparatus 100 to the condensate line and an outlet exits the apparatus 100 to allow for drainage of the condensate. The outlet is configured to be lower than the inlet so that the water flow may be assisted by gravity. A housing, preferably constructed of durable, weatherproof materials surrounds the vacuum, the control unit, and associated electronics and electrical components. In a preferred embodiment, the inlet and outlet are integral to the housing.

In a preferred embodiment, the apparatus 100 is a self-contained unit where the vacuum, control unit, valves, and actuators are all contained within a weatherproof housing with integral inlet and outlet. The apparatus 100 would further include a properly rated power cord for plugging into a standard electrical outlet, or for hard-wiring directly to a power supply.

A person having ordinary skill in the art will recognize that the vacuum, the control unit, and associated electronics and electrical components will require a source of electrical power, air-tight and water-tight seals, and related electromechanical components in order to for the invention to be enabled. While not detailed here for compactness of disclosure, it is to be understood that the apparatus 100 may be powered by plugging it into the household electrical circuit or hard-wiring it into a power supply. Further embodiments may comprise power supplies such as rechargeable batteries, solar panels, or other ways to power the vacuum, controller, and associated electronics.

Further embodiments of the present invention include a housing with features for mounting the apparatus 100 to a structure such as a brick or concrete slab.

Other embodiments of the present invention contemplate the connection of the apparatus to the condensate drain line via a flexible tube sealably connected between the condensate drain line and the apparatus input.

In embodiments, the apparatus 100 further includes a valve located at the outlet. This valve is normally open to allow the unimpeded flow of condensate. Upon activation of a vacuum cycle by the controller, the controller sends a signal to a motor attached to the valve located at the outlet, causing the valve to close, thereby sealing the outlet. Once the valve is closed, the controller turns on the vacuum for a predetermined period of time sufficient enough to suck out any algae build up in the line or drain pan itself. After the vacuum cycle is complete, the control will deactivate the vacuum and send a signal to open the valve at the outlet, thereby allowing the collected algae and water to drain out. The valve at the outlet will then remain open until the next vacuum cycle.

Embodiments of the invention further contemplate logic and sensor means operably coupled to the apparatus 100 so that a user may operate the apparatus 100 through a specially programmed wireless communication device enabled with a user interface and communicatively coupled via a communications network. Alternatively, the user may choose to program the apparatus 100 to react automatically based upon environmental inputs such as the detection of predetermined levels of condensate flow, the presence of water, algae, or other stimulus.

Figure 2:
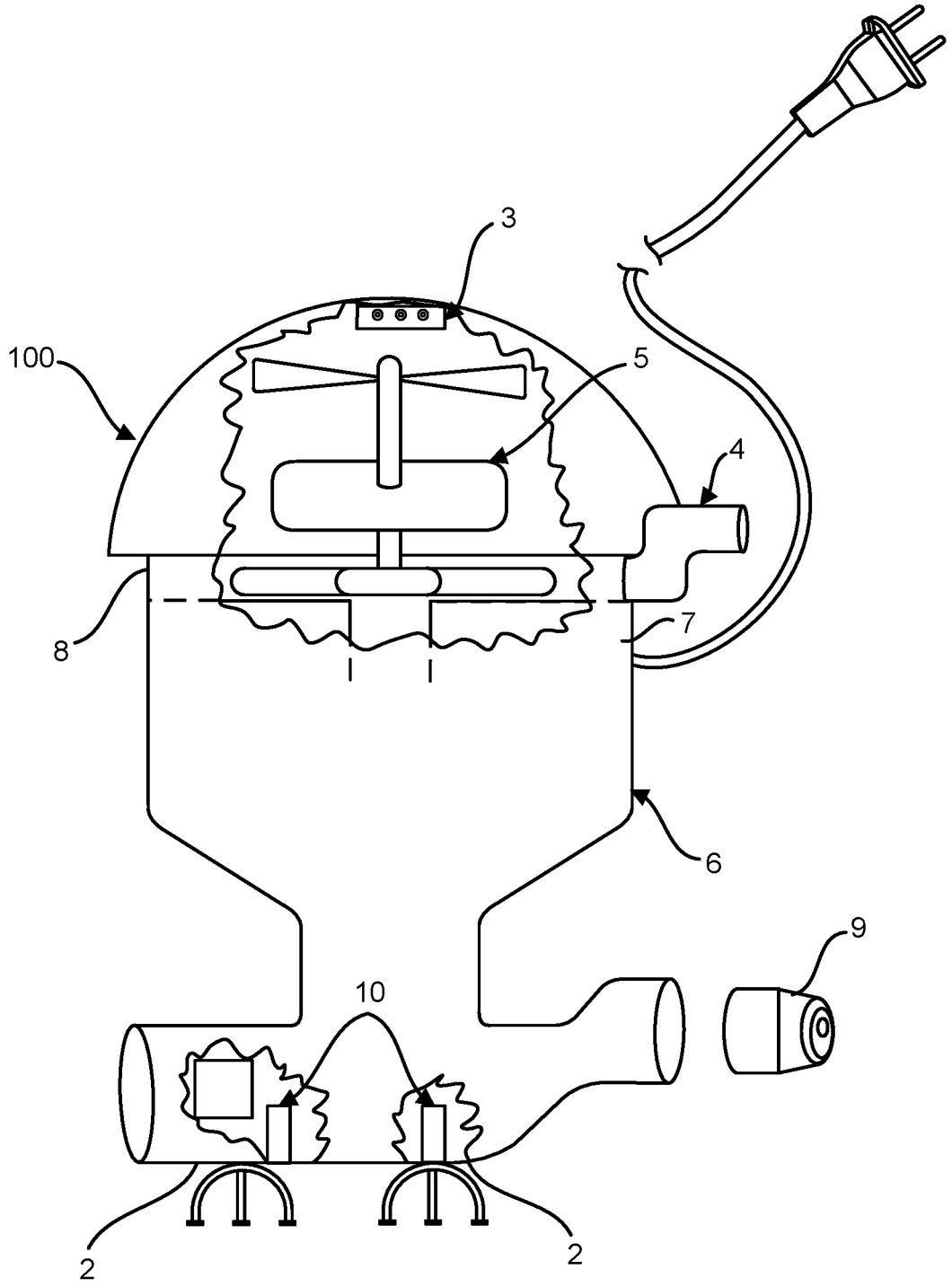
FIG. 2 is another simplified depiction of the apparatus of FIG. 1, showing a power cord providing power to the apparatus, according to an embodiment.

FIG. 2 shows a view of the apparatus 100 and a power cord.

Figure 3:
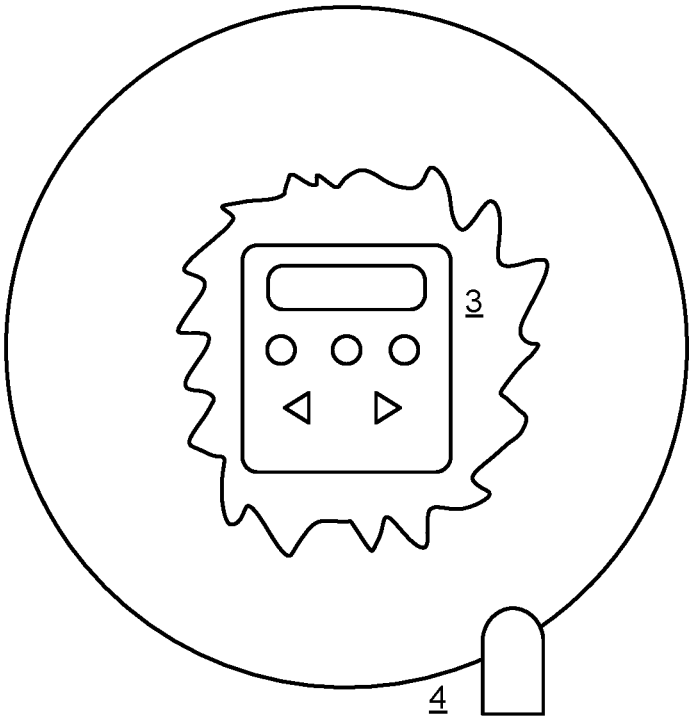
FIG. 3 is a simplified depiction of the dome access covering the motor and electro-mechanical components of the apparatus of FIG. 1, according to an embodiment.

FIG. 3 shows a water-proof dome, or equivalent cover, covering the motor and the electro-mechanical components, such as the digital timer. Using the timer, a user of the apparatus 100 will be able to set a schedule for clearing the drain line. Alternatively, the apparatus 100 can be activated by radio frequency control. In another embodiment, the apparatus 100 is activated when a water sensor indicates that the water level is beyond a pre-determined threshold. An exhaust pipe 4 (see FIGS. 2 and 3) is attached to the main body and is operatively communicative with the vacuum in order to vent air from the line.

Figure 4:
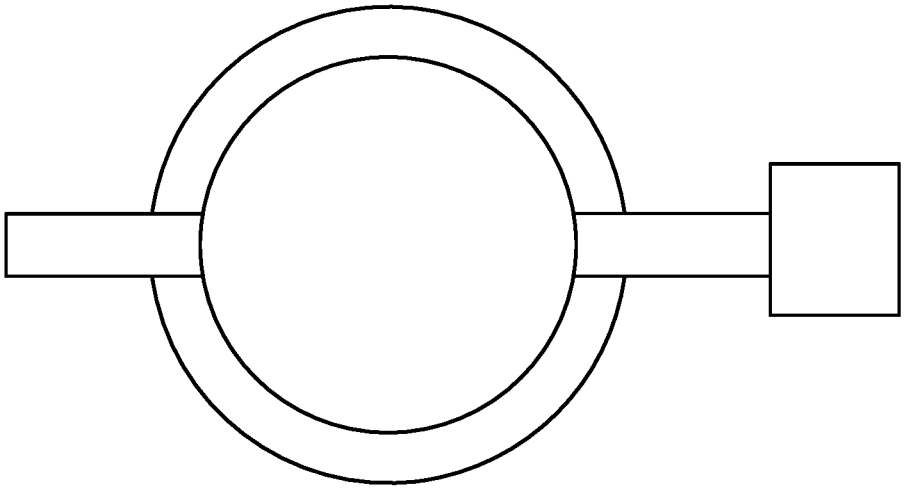
FIG. 4 shows the bottom view of the apparatus, according to an embodiment.

FIG. 4 shows a bottom view of the main body of the apparatus 100. A damper/rubber seal can serve to both steady the apparatus 100 and prevent water intrusion.

Figure 5:
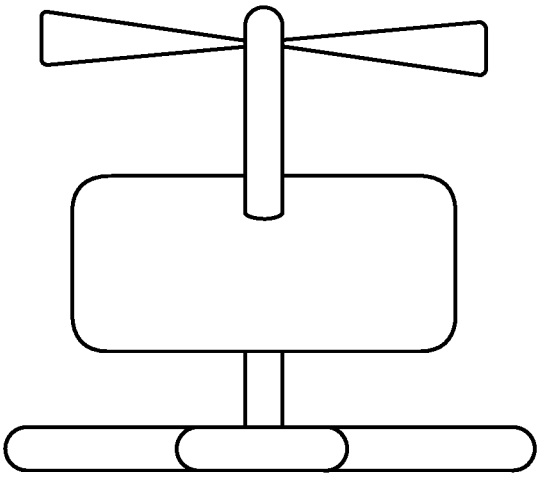
FIG. 5 shows the main motor vacuum, according to an embodiment.

FIG. 5 shows the main motor vacuum which is disposed within the dome. Any type of motor capable of drawing a vacuum, as may be known in the art, can be used.

Figure 6A:
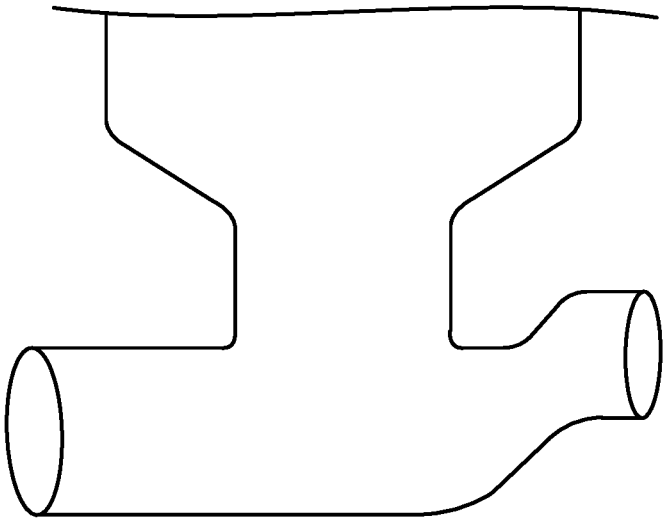
FIG. 6A shows a front view of the body of the apparatus, according to an embodiment.
Figure 6B:
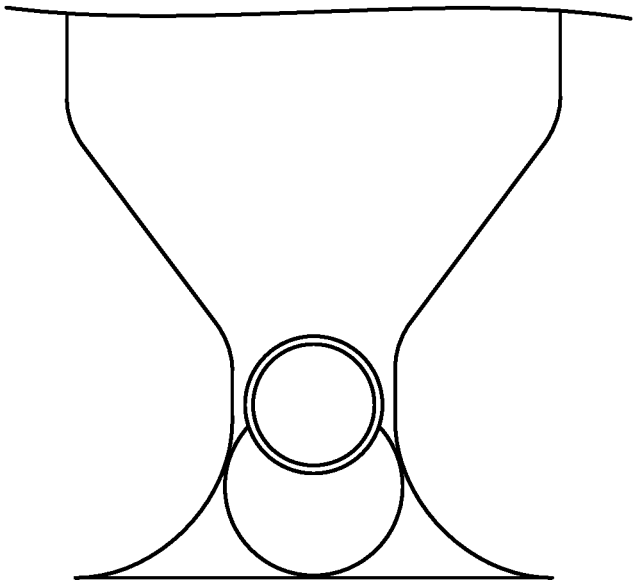
FIG. 6B shows a side view of the body of the apparatus, according to an embodiment.

FIGS. 6A and 6B show two views of the main body of the apparatus 100. FIG. 6A shows a front view of the main body of the apparatus 100; while FIG. 6B shows a side view. Preferably, the main body is constructed from highly durable, weatherproof plastic. The main body is held upright by a stand. The stand is built-in with holes to fasten it down. In one embodiment, the main body includes the inlet and outlet portions. The inlet and outlet portions feature two-inch openings to accommodate most condensate drain line diameters. In embodiments, the apparatus 100 is supplied with a reducer for accommodating hoses of a small diameter. FIG. 6A shows that the inlet is higher than the outlet to assist with drainage and flow. FIG. 6A shows a two-inch offset. Those with knowledge in the art will appreciate that a two-inch offset is just an example.

Figure 7:
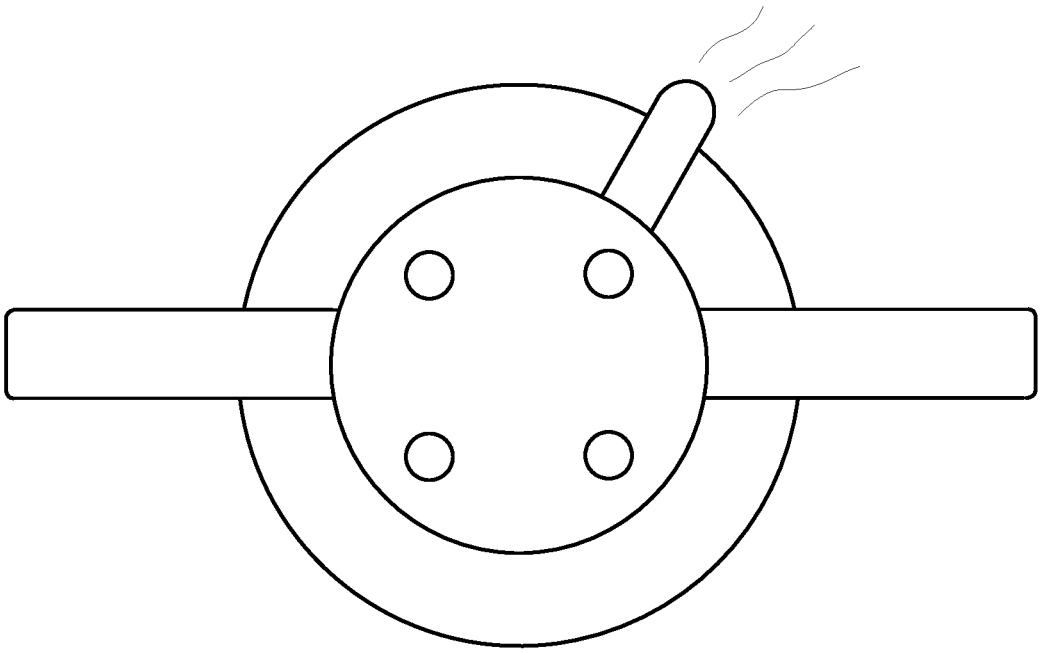
FIG. 7 shows a bottom plate for impeller intake, according to an embodiment.
Figure 8:
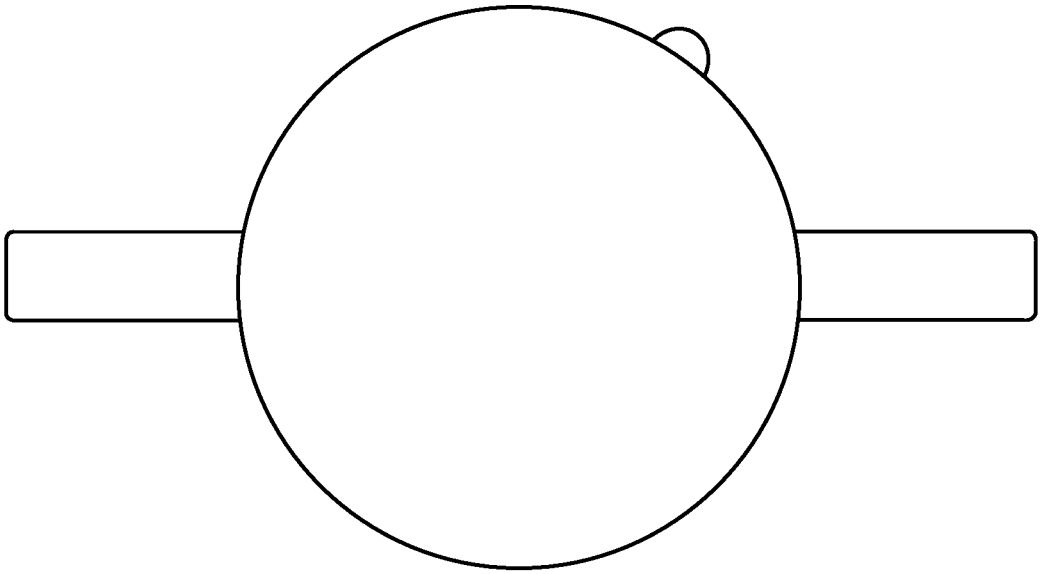
FIG. 8 shows a top plate for motor rest, according to an embodiment.

Referring to the figures in general and FIGS. 7 and 8 in particular, the vacuum motor is mounted to plate 8 or similar structure in sealed relation to the housing, such that an impeller attached to the motor is capable of creating a vacuum in the system by drawing air through the bottom plate 7.

Figure 9:
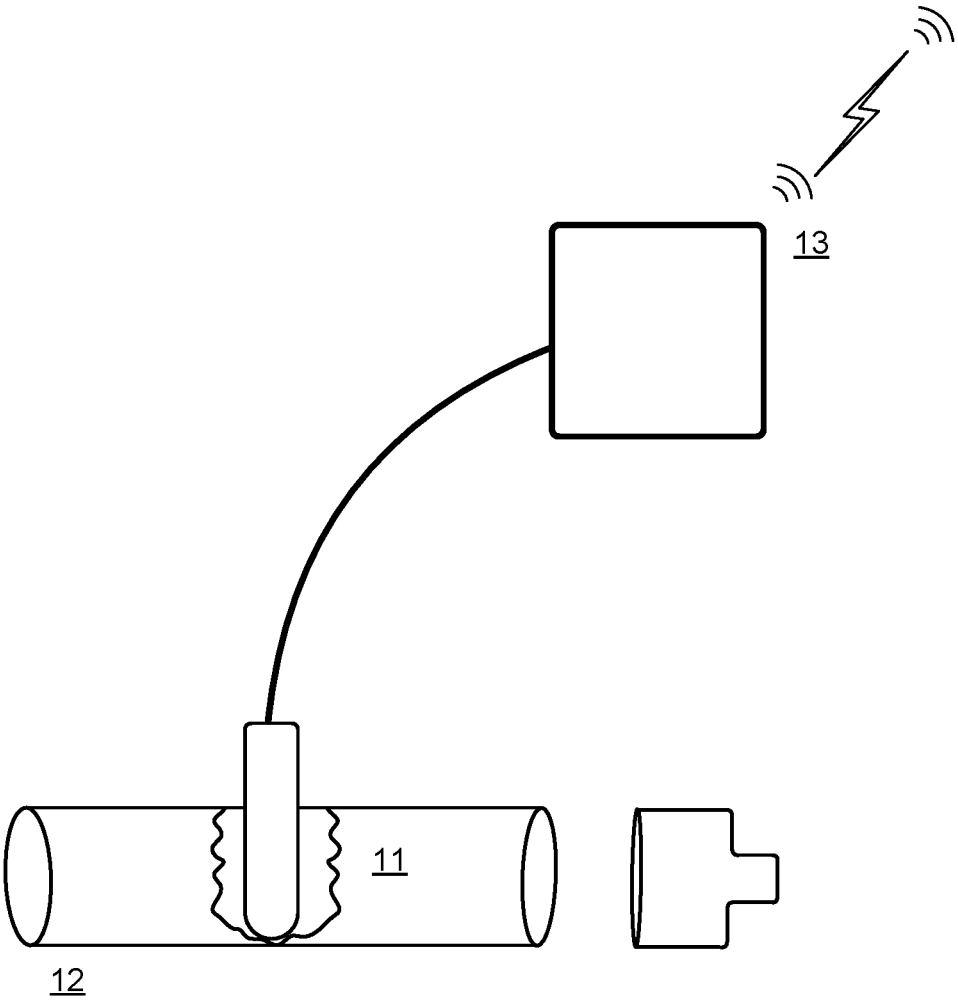
FIG. 9 shows an example of a water sensor in communication with a control unit, according to an embodiment.

FIG. 9 shows an example of how activation of the apparatus 100 can be triggered by a water sensor in operative communication with a radio frequency control unit. When the water sensor detects water in the tube from overflow, it will send a signal to the control unit, thereby activating the vacuum. The radio frequency unit 13 may further include a magnet so that it can be easily attached to the outside of an air handler unit.

Figure 10:
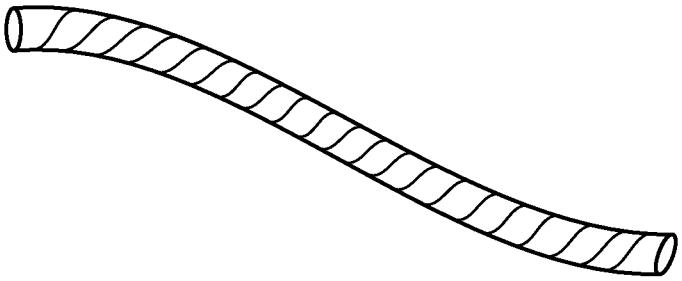
FIG. 10 shows an example of a hose attachment, according to an embodiment.

FIG. 10 shows an example of a hose attachment for attaching to an existing tube or drain line, as required.

Further embodiments of the apparatus 100 may also include an electronics and control module (ECM). The ECM components can be realized each as one or more computing devices, executing a variety of scripts, databases, processes, and related components. One with knowledge in the art will appreciate that the components may represent all hardware components, all software components, or a combination of hardware and software components.

The ECM is operably coupled to the main motor vacuum as well as to one or more motorized valve. The ECM may be configured to provide electrical power to the vacuum and the one or more motorized valve. The ECM may also be configured with sensors and logic circuits in order to perform various additional functions.

For example, embodiments of the invention may be configured with a one or more water sensor. This sensor would be electrically coupled with the ECM such that, when the ECM detects buildup of water in the drain line or drain pan, the ECM logic circuit sends a signal for the apparatus 100 to begin a vacuum cycle, as described above.

Still further embodiments of the apparatus 100 may also include dedicated hardware and software for enabling wireless communication over a network. In such an embodiment, the ECM may further include dedicated hardware and software so that the apparatus 100 appears as a node on a data network. Another node on the data network, such as a specially programmed computing device, may then communicate with the apparatus 100 via the ECM. In this way, a person utilizing the specially programmed computing device may, for example, set the vacuum cycle schedule, or manually start a vacuum cycle. Additional information may be communicated by the ECM, such as data from the one or more sensors.

By way of illustration, and not limitation, an embodiment of the apparatus 100 may be configured as a Bluetooth-enabled device. A homeowner may download and install a mobile application onto a Bluetooth-enabled mobile computing device, thereby converting the device into a specially programmed computing device. Through a user interface provided by the mobile application, the user may view the status of the apparatus 100, view alerts, or set operation parameters for the apparatus 100.

Further embodiments of the apparatus 100 are configured to place the apparatus 100 as a node on a local area network, or as a node accessible via a wide area network, or even the Internet.

The Data Network comprises a single or a plurality of connected data networks, including private and public networks, including the Internet, and such networks may or may not be comprised of circuits or components across multiple business entities, service providers, physical and protocol layer data networking methods and technologies, and located across diverse physical locations.

In one embodiment, the ECM comprises a physical computing device configured with network connectivity, such as Ethernet IEEE 802.3, Wireless such as IEEE 802.11, Bluetooth, ZigBee, or Cellular Wireless such as GSM. Such dedicated computing device further comprises a microprocessor device which communicates with an input/output subsystem, memory, storage and network interface. The microprocessor device is operably coupled with a communication infrastructure herein represented as bus. Bus is a simplified representation of the communication infrastructure required in a device of this type.

The microprocessor device may be a general or special purpose microprocessor operating under control of computer program instructions executed from memory on program data. The microprocessor may include a number of special purpose sub-processors, each sub-processor for executing particular portions of the computer program instructions. Each sub-processor may be a separate circuit able to operate substantially in parallel with the other sub-processors. Some or all of the sub-processors may be implemented as computer program processes (software) tangibly stored in a memory that perform their respective functions when executed. These may share an instruction processor, such as a general purpose integrated circuit microprocessor, or each sub-processor may have its own processor for executing instructions. Alternatively, some or all of the sub-processors may be implemented in an ASIC. RAM may be embodied in one or more memory chips.

Memory may include both volatile and persistent memory for the storage of: operational instructions for execution by Microprocessor, data registers, application storage and the like. The computer instructions/applications that are stored in memory are executed by processor. The I/O subsystem may comprise various end user interfaces such as a display, a keyboard, and a mouse. The I/O subsystem comprises a data network interface. The network interface allows software and data to be transferred between the ECM and external hosts or devices. Examples of network interface can include one or a plurality of: Ethernet network interface card, wireless network interface card, network interface adapter via USB, wireless cellular modem, and the like. Data transferred via network interface are in the form of signals which may be, for example, electronic, electromagnetic, radio frequency, optical, or other signals capable of being transmitted or received by network interface.

For purposes of this disclosure, the user's device may also represent any type of computer, information processing system, or other programmable electronic device, including a client computer, a server computer, a portable computer such as a laptop device, an embedded controller, a software or microcode embedded in devices or appliances such as a mobile telephone such as an Apple iPhone, Television sets, Air Conditioning thermostats, home alarm systems, application-specific integrated circuit (ASIC), special-purpose microcontrollers, and the like that has been specially programmed to perform the functions of interfacing and communicating with the ECM as disclosed herein.

While the invention as claimed can be modified into alternative forms, specific embodiments thereof are shown by way of example in the appended drawings. It should be understood, however, that the drawings and detailed description thereto are not intended to limit the invention to the particular form disclosed, but on the contrary, the intention is to cover all modifications, equivalents and alternatives falling within the scope of the present disclosure.

It should be observed that some of the embodiments may reside primarily in combinations of method steps and system components related to systems and methods for placing computation inside a communication network. Accordingly, the system components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible computing or communications embodiment may not be depicted in order to facilitate a less obstructed view of these various embodiments.

Further, in view of many embodiments to which the principles of the invention may be applied, it should be understood that the illustrated embodiments are exemplary embodiments and should not limit the present disclosure.

Therefore, while there has been described what is presently considered to be the preferred embodiment, it will be understood by those skilled in the art that other modifications can be made within the spirit of the disclosure. The above description(s) of embodiment(s) is not intended to be exhaustive or limiting in scope. The embodiment(s), as described, were chosen in order to explain the principles of the invention, show its practical application, and enable those with ordinary skill in the art to understand how to make and use the invention. It should be understood that the invention is not limited to the embodiment(s) described above, but rather should be interpreted within the full meaning and scope of the disclosure.

The invention claimed is:

1. An apparatus for removing clogs from a condensate drain line, the apparatus comprising:

an apparatus inlet sealably connected to the condensate drain line at an end of the condensate drain line, where the end of the condensate drain line is after a condensate drain line trap;

a vacuum device operably communicative with the apparatus inlet configured to draw a vacuum from within the condensate drain line;

an exhaust pipe operably communicative with the vacuum device configured to vent air from the condensate drain line as the vacuum device draws the vacuum;

a control unit in operable communication with the vacuum device;

an apparatus outlet in fluid communication with the apparatus inlet configured for drainage of the condensate, wherein the outlet is disposed lower than the inlet;

a motorized valve, in operable communication with the control unit, disposed at the apparatus outlet, selectively positionable by the control unit between an open and a closed position, where the motorized valve is normally in the open position to allow the unimpeded flow of condensate and upon activation of a vacuum cycle by the control unit, the motorized valve receives a signal from the control unit causing the motorized valve to close and, after the vacuum cycle is complete, the motorized valve received a signal from the control unit to open, thereby allowing any vacuumed condensate to drain out;

a housing with a watertight seal, surrounding the vacuum device, the control unit, and associated electronics and electrical components; and a power supply powering the vacuum device, the control unit, and the motorized valve.

2. The apparatus of claim 1, wherein the apparatus inlet and the apparatus outlet are integral to the housing.

3. The apparatus of claim 1, further comprising a water sensor in operative communication with the control unit, the water sensor sensing a water level above a pre-determined threshold and triggering activation of the vacuum.

4. The apparatus of claim 1, wherein the control unit further comprises a timer to operate the vacuum at pre-set intervals.

5. The apparatus of claim 1, further comprising a tube sealably connecting the apparatus inlet with the condensate drain line.

6. The apparatus of claim 1, further comprising a mounting mechanism attaching the apparatus to a structure.

* * * * *